US010337817B2

(12) United States Patent
Wilson

(10) Patent No.: US 10,337,817 B2
(45) Date of Patent: Jul. 2, 2019

(54) FIREARM TRIGGER ASSEMBLY

(71) Applicant: Sig Sauer, Inc., Newington, NH (US)

(72) Inventor: John Wilson, East Waterboro, ME (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/454,448

(22) Filed: Mar. 9, 2017

(65) Prior Publication Data

US 2017/0176124 A1 Jun. 22, 2017

Related U.S. Application Data

(63) Continuation of application No. 14/634,017, filed on Feb. 27, 2015, now Pat. No. 9,618,288.

(60) Provisional application No. 61/948,786, filed on Mar. 6, 2014.

(51) Int. Cl.

| | |
|---|---|
| ***F41A 19/14*** | (2006.01) |
| ***F41A 19/10*** | (2006.01) |
| ***F41A 19/12*** | (2006.01) |

(52) U.S. Cl.

CPC ..... *F41A 19/14* (2013.01); *F41A 19/10* (2013.01); *F41A 19/12* (2013.01)

(58) Field of Classification Search

CPC ..... F41A 19/14
USPC ..... 42/69.03; 89/146
See application file for complete search history.

(56) References Cited

U.S. PATENT DOCUMENTS

| | | | | |
|---|---|---|---|---|
| 2,600,176 | A * | 6/1952 | Williams | F41A 19/42 42/69.03 |
| 3,903,631 | A * | 9/1975 | Vesamaa | F41A 17/74 42/41 |
| 4,429,617 | A | 2/1984 | Ruger | |
| 5,501,134 | A | 3/1996 | Milazzo et al. | |
| 5,623,114 | A | 4/1997 | Soper | |
| 5,718,074 | A | 2/1998 | Keeney | |
| 5,881,485 | A | 3/1999 | Milazzo | |

(Continued)

OTHER PUBLICATIONS

Knight's Armament, "4.5lb 2-Stage Match Trigger for Increased Confidence and Accuracy" [retrieved from internet on Jul. 27, 2015] <URL: http://www.knightarmco.com/portfolio/4-5lb-2-stage-match-trigger>, 1 page.

(Continued)

*Primary Examiner* — Reginald S Tillman, Jr.
(74) *Attorney, Agent, or Firm* — Finch & Maloney PLLC

(57) ABSTRACT

A firearm trigger assembly is disclosed. The disclosed assembly may include a trigger, a disconnect, and a hammer, each of which may be configured to be spring loaded when installed in a firearm receiver. Installation of the trigger assembly in a firearm receiver may include pivotally coupling the trigger and disconnect to the firearm receiver using a trigger pivot pin, and pivotally coupling the hammer to the firearm receiver using a hammer pivot pin. The trigger may include an integral sear feature configured to provide a mechanical stop to the hammer. The disconnect may be configured to be at least partially located in a disconnect slot located alongside or adjacent to the trigger sear feature when the disconnect is pivotally coupled to the trigger. The disconnect and hammer may each include integral cam features configured to buffer hammer contact during firearm recoil.

11 Claims, 12 Drawing Sheets

(56) References Cited

U.S. PATENT DOCUMENTS

| | | | | |
|---|---|---|---|---|
| 5,924,231 | A | 7/1999 | Kidd | |
| 6,131,324 | A | 10/2000 | Jewell | |
| 6,588,136 | B2 * | 7/2003 | Baker | F41A 19/48 42/70.02 |
| 6,615,527 | B1 | 9/2003 | Martin | |
| 6,722,072 | B1 | 4/2004 | McCormick | |
| 6,772,548 | B1 | 8/2004 | Power | |
| 7,162,824 | B1 | 1/2007 | McCormick | |
| 7,293,385 | B2 | 11/2007 | McCormick | |
| 7,331,136 | B2 | 2/2008 | Geissele | |
| 7,600,338 | B2 | 10/2009 | Geissele | |
| 7,854,084 | B1 | 12/2010 | Rutherford | |
| 7,992,335 | B2 | 8/2011 | Gangl | |
| 8,069,602 | B2 | 12/2011 | Geissele | |
| 8,074,393 | B2 | 12/2011 | Geissele | |
| 8,112,928 | B2 | 2/2012 | Keough | |
| D659,790 | S | 5/2012 | Geissele | |
| 8,893,607 | B2 | 11/2014 | Audibert et al. | |
| 9,057,573 | B1 * | 6/2015 | Cockerham | F41A 19/14 |
| 9,618,288 | B2 | 4/2017 | Wilson | |
| 2009/0183414 | A1 | 7/2009 | Geissele | |
| 2010/0281739 | A1 | 11/2010 | Geissele | |
| 2015/0253095 | A1 | 9/2015 | Wilson | |

OTHER PUBLICATIONS

HKParts.net; "HK 416 Trigger—Geissele" [retrieved from internet on Jul. 27, 2015] <URL: http://www.hkparts.net/shop/pc/HK-416-Trigger-Geissele-p16477.htm>, 2 pages.

HKParts.net; "HK 417 Trigger—Geissele" [retrieved from internet on Jul. 27, 2015] <URL: hkparts.net/shop/pc/HK-417-Trigger-Geissele-p16478.htm>, 2 pages.

HKParts.net; "HK MR556 Trigger—Geissele" [retrieved from internet on Jul. 27, 2015] <URL: hkparts.net/shop/pc/HK-MR556-Trigger-Geissele-135p16464.htm>, 2 pages.

HKParts.net; "HK MR762 Trigger—Geissele" [retrieved from internet on Jul. 27, 2015] <URL: hkparts.net/shop/pc/HK-MR762-Trigger-Geissele-p16463.htm>, 2 pages.

* cited by examiner

FIREARM TRIGGER ASSEMBLY

CROSS-REFERENCE TO RELATED APPLICATIONS

This application is a continuation of U.S. patent application Ser. No. 14/634,017, filed on Feb. 27, 2015, which claims the benefit of U.S. Provisional Patent Application No. 61/948,786, filed on Mar. 6, 2014. Both applications are herein incorporated by reference in their entirety.

FIELD OF THE DISCLOSURE

The disclosure relates to firearms and more particularly to a firearm trigger assembly.

BACKGROUND

Firearm design involves a number of non-trivial challenges, including the design of firearm trigger mechanisms. Triggers are used to actuate the firing sequence of a firearm and can include levers or buttons actuated by a shooter's index finger. Considerations related to the design of a firearm trigger may include the number of stages, pull weight, feedback, and method of assembly/installation.

SUMMARY

One example embodiment of the present invention provides a firearm trigger assembly comprising: a trigger including an integral trigger sear feature, wherein the trigger is configured to be pivotally coupled to a firearm receiver using a trigger pivot pin and wherein the trigger includes a disconnect slot alongside the trigger sear feature; a disconnect including an integral disconnect cam, wherein the disconnect is configured to be pivotally coupled to the trigger and wherein the disconnect is at least partially located in the disconnect slot when pivotally coupled to the trigger; and a hammer including an integral hammer sear feature and an integral hammer cam, wherein the hammer is configured to be pivotally coupled to the receiver using a hammer pivot pin. In some cases, the hammer cam contacts the disconnect cam during firearm recoil to buffer the impact between the hammer and the disconnect. In some cases, the hammer has a center of percussion and wherein the hammer cam contacts a body portion of the disconnect approximate to the center of percussion of the hammer during firearm recoil. In some cases, the disconnect cam provides a variable resistance to hammer rotation during firearm recoil, the variable resistance having a low initial resistance and increasing with continued rotation of the hammer. In some cases, the trigger assembly further comprises a disconnect spring configured to be positioned between the disconnect and hammer, wherein the disconnect spring is in compression when the disconnect and hammer are pivotally coupled. In some such cases, the disconnect includes a stop surface configured to prevent over-rotation of the disconnect during firearm recoil. In some cases, the trigger assembly further comprises: a trigger spring configured to be in compression and apply torque to the trigger when the trigger is pivotally coupled to the receiver; and a hammer spring configured to be in compression and apply torque to the hammer when the hammer is pivotally coupled to the receiver. In some cases, the trigger pivot pin and hammer pivot pin are both selected from M16 rifle trigger pivot pins. In some cases, the trigger assembly further comprises a hammer pivot pin retainer configured to non-permanently retain the hammer pivot pin in the hammer, wherein the hammer pin retainer is further configured to be inserted into the hammer in a direction substantially parallel to a major axis of the hammer pivot pin. In some cases, the trigger sear feature is configured to provide a mechanical stop to the hammer sear feature when the hammer is in a ready-to-fire position and thereby prevent rotation of the hammer in a firing direction. In some cases, the firearm trigger assembly is a two-stage trigger mechanism. In some cases, the trigger is configured to have a pull weight between 0.91 kg (2 lbs) and 2.49 kg (5.5 pounds) when pivotally coupled to the receiver. In some cases, the trigger assembly is included in a firearm.

Another example embodiment of the present invention provides a hammer for a firearm trigger mechanism, the hammer comprising: an integral sear feature; an integral cam feature; a pivot pin hole; and at least one pivot pin retainer aperture; wherein the axis of the at least one pivot pin aperture is substantially parallel to the axis of the pivot pin hole. In some cases, the hammer is configured to be pivotally coupled to a firearm receiver using a pivot pin. In some cases, the hammer further comprises a pivot pin retainer configured to non-permanently retain a pivot pin in the hammer, wherein the pivot pin retainer is further configured to be inserted into the at least one pivot pin retainer aperture.

Another example embodiment of the present invention provides a trigger for a firearm trigger mechanism, the trigger comprising: an integral sear feature; a disconnect slot alongside the integral sear feature; and a pivot pin hole; wherein the disconnect slot is configured to receive a disconnect of the trigger mechanism. In some cases, the trigger is configured to be pivotally coupled to a firearm receiver using a pivot pin. In some cases, the trigger is configured to pivotally couple to the disconnect. In some such cases, the trigger further comprises a spring receiver slot configured to receive a spring to spring-load the disconnect.

Another example embodiment of the present invention provides a firearm trigger assembly comprising: a trigger configured to be pivotally coupled to a firearm receiver using a trigger pivot pin; a disconnect including an integral disconnect cam, wherein the disconnect is configured to be pivotally coupled to the trigger; and a hammer including an integral hammer cam, wherein the hammer is configured to be pivotally coupled to the receiver using a hammer pivot pin; wherein the disconnect cam provides a variable resistance to hammer rotation during firearm recoil, the variable resistance having a low initial resistance and increasing with continued rotation of the hammer.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
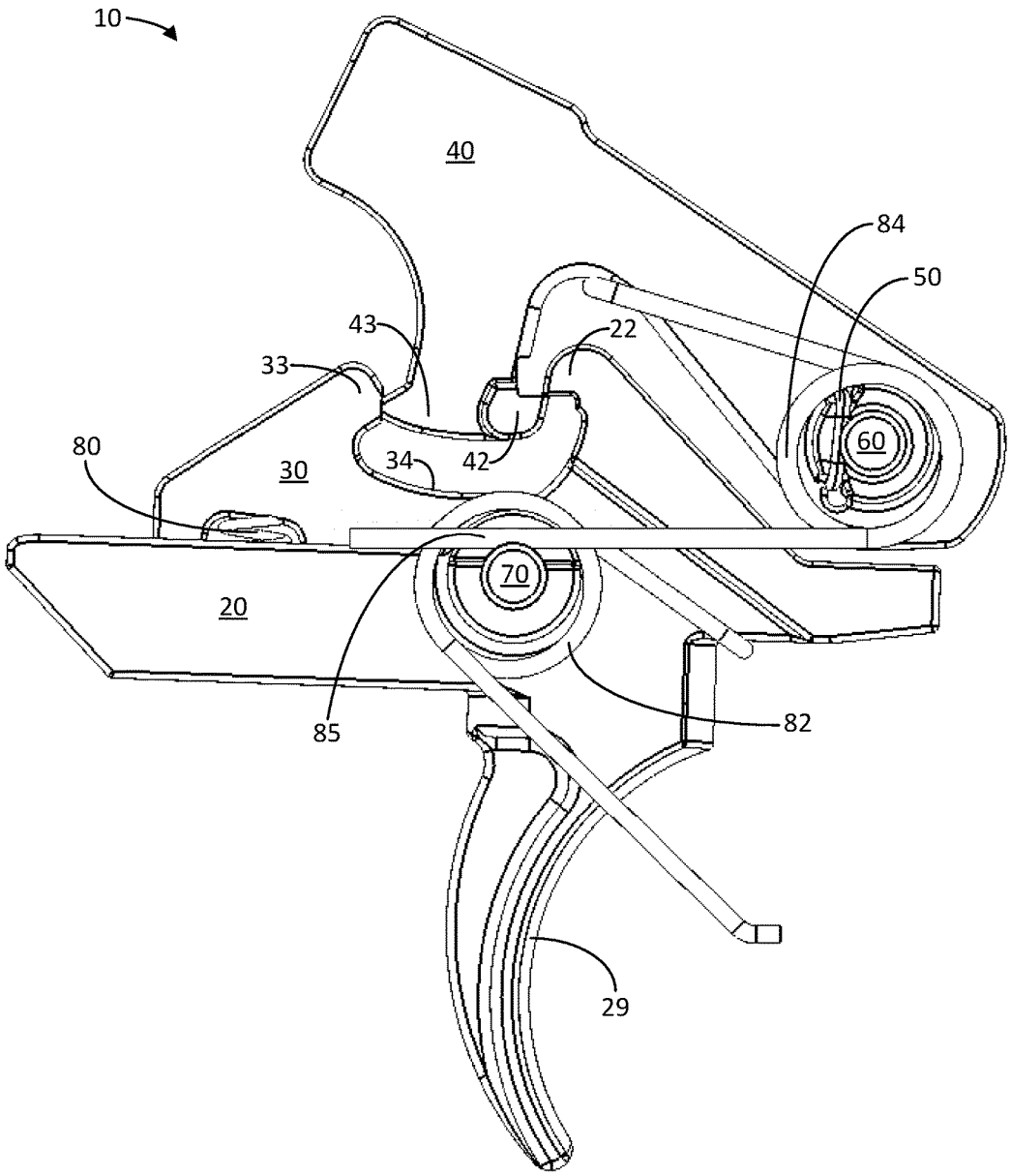
FIGS. 1 and 2 illustrate a right planar view and an exploded view, respectively, of a trigger assembly, in accordance with an embodiment of the present invention.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed invention to the specific configurations shown. In short, the figures are provided merely to show example structures.

DETAILED DESCRIPTION

A firearm trigger assembly is disclosed. The disclosed assembly may include a trigger, a disconnect, and a hammer, each of which may be configured to be spring loaded when installed in a firearm receiver. Installation of the trigger assembly in a firearm receiver may include pivotally coupling the trigger and disconnect to the firearm receiver using a trigger pivot pin, and pivotally coupling the hammer to the firearm receiver using a hammer pivot pin. The trigger may include an integral sear feature (e.g., a sear hook) configured to provide a mechanical stop to an integral sear feature (e.g., a sear hook) on the hammer. In some cases, the disconnect may be configured to be at least partially located in a disconnect slot located alongside or adjacent to the trigger sear feature when the disconnect is pivotally coupled to the trigger. In some instances, the disconnect may include an integral cam configured to buffer hammer contact during firearm recoil. In some such instances, the hammer may also include an integral cam configured to first make contact with the disconnect cam. In some cases, a hammer pin retainer may be used to non-permanently retain the hammer pivot pin in the hammer. The hammer pin retainer may be configured to be inserted into the hammer in a direction substantially parallel to a major axis of the hammer pivot pin. Numerous configurations and variations will be apparent in light of this disclosure.

General Overview

As previously indicated, there are a number of non-trivial issues related to the design of a firearm trigger mechanism. Hammer energy levels during the recoil stroke of an auto-loading firearm have increased overtime as a result of, for example, newer firearm designs, newer cartridges, and the use of sound suppressors. Increased hammer energy levels can result in springs used in conventional trigger mechanisms being over-compressed, trigger mechanisms stopping with greater intensity, and more force being directed against a shooter's finger, for example. Increased hammer energy levels can also result in parts failure and increased trigger/finger-slap in conventional trigger mechanisms, as a result of the increase in rate of fire.

Thus, and in accordance with a set of embodiments of the present invention, a trigger assembly for a firearm is disclosed. In some embodiments, the trigger assembly may include a trigger, a disconnect, and a hammer, each of which may be configured to be individually spring-loaded when installed in a firearm receiver (e.g., using a trigger spring, disconnect spring, and hammer spring, respectively). In some embodiments, installation of the trigger assembly in a firearm receiver may include pivotally coupling the trigger and disconnect to the firearm receiver (and pivotally coupling the trigger and disconnect to each other) using a trigger pivot pin, and pivotally coupling the hammer to the firearm receiver using a hammer pivot pin. The trigger may include, in some embodiments, an integral trigger sear feature (e.g., a sear hook) and a disconnect slot alongside or adjacent to the trigger sear feature. The disconnect may include, in some embodiments, an integral disconnect cam and may be configured to be pivotally coupled to the trigger. In some such embodiments, the disconnect may be at least partially located in the disconnect slot (located alongside or adjacent to the trigger sear feature) when pivotally coupled to the trigger. The hammer, in some embodiments, may include an integral hammer sear feature (e.g., on a sear hook) and an integral hammer cam. In some such embodiments, the trigger sear feature may be configured to provide a mechanical stop to the hammer sear feature when the hammer is in a ready-to-fire position, thereby preventing rotation of the hammer in a firing direction.

As will be appreciated in light of this disclosure, some embodiments may realize benefits or advantages as compared to existing approaches. For instance, in some embodiments, the hammer may be configured to contact the disconnect during firearm recoil in a manner that buffers the impact between the hammer and the disconnect (e.g., via interaction of an integral hammer cam and an integral disconnect cam). This may be achieved, in some embodiments, as a result of the hammer first contacting the disconnect during recoil to create a contact force vector having a direction substantially away from the trigger pivot pin (thereby setting the disconnect in motion while creating little resistance to hammer travel), but shifting toward the trigger pivot pin with continued hammer travel during firearm recoil. This action can create a variable resistance to hammer over-travel which is first weak, and then increases with continued hammer travel during firearm recoil. This buffering or feedback effect may direct a portion of the excess kinetic energy from the hammer during recoil toward the firearm receiver (e.g., via the trigger pivot pin) and may also reduce or limit the amount of energy transferred to the trigger and to the shooter's trigger finger (also known as finger/trigger slap). The buffering effect provided by the hammer and disconnect may also minimize peak loads generated in stopping the hammer, which may help prevent parts failure in the trigger assembly. This is particularly advantageous with higher rates of fire, such as rates of fire that exceed 1000 rounds per minute, for example.

In some embodiments, contact between the hammer and the main body of the disconnect may occur approximate to the center of percussion of the hammer, thereby transferring low amounts of energy or force to the hammer pivot pin. Further, in some embodiments, the disconnect may be stronger in the area of hammer contact and the disconnect may include a stop surface to prevent over-rotation of (and potential damage to) the disconnect spring. In some embodiments, a hammer pin retainer may be used to non-permanently retain the hammer pivot pin in the hammer. The hammer pin retainer may be configured to be inserted into the hammer in a direction substantially parallel to a major axis of the hammer pivot pin (or substantially parallel to a major axis of the hole in the hammer that the hammer pivot pin is configured to insert into). The hammer pin retainer allows for the use of a hammer pivot pin that lacks a problematic central groove, as will be discussed herein. For example, the hammer pin retainer may be configured to allow a second instance of a trigger pivot pin of an M16 to be used with the trigger assembly, and the M16 trigger pivot pin may be inherently stronger than conventional hammer pivot pins (e.g., an M16 hammer pivot pin). In some embodiments, the hammer pin retainer may allow for a simpler, lighter, and less expensive hammer, as a result of, for example, the use of the hammer pin retainer as variously described herein.

Some embodiments may have a small number of parts or components (especially compared to conventional trigger mechanisms), and the components may be simple parts that are easy to manufacture or construct, as will be apparent in light of this disclosure. In some embodiments, the trigger assembly may be designed to be match grade (making it suitable for a competitive match and/or designed with high precision in mind). For example, the trigger assembly may be configured to have a relatively low overall pull weight (e.g., a pull weight between 0.91 kg (2 lbs) and 2.49 kg (5.5 pounds) when pivotally coupled to a firearm receiver) to allow for easier firing using the trigger assembly. As will also be apparent, installing the trigger assembly components on a firearm receiver may be simple and intuitive. Also, in some embodiments, a reduction in cost (e.g., of production, of repair, of replacement, etc.) may be realized. In some cases, and in accordance with some embodiments, a trigger assembly as variously described herein can be configured, for example, as: (1) a partially/completely assembled trigger assembly unit; and/or (2) a kit or other collection of discrete components (e.g., a trigger, a disconnect, a hammer, etc.) which may be configured to assemble as desired. Numerous configurations and variations will be apparent in light of this disclosure.

Structure and Operation

Figure 2:
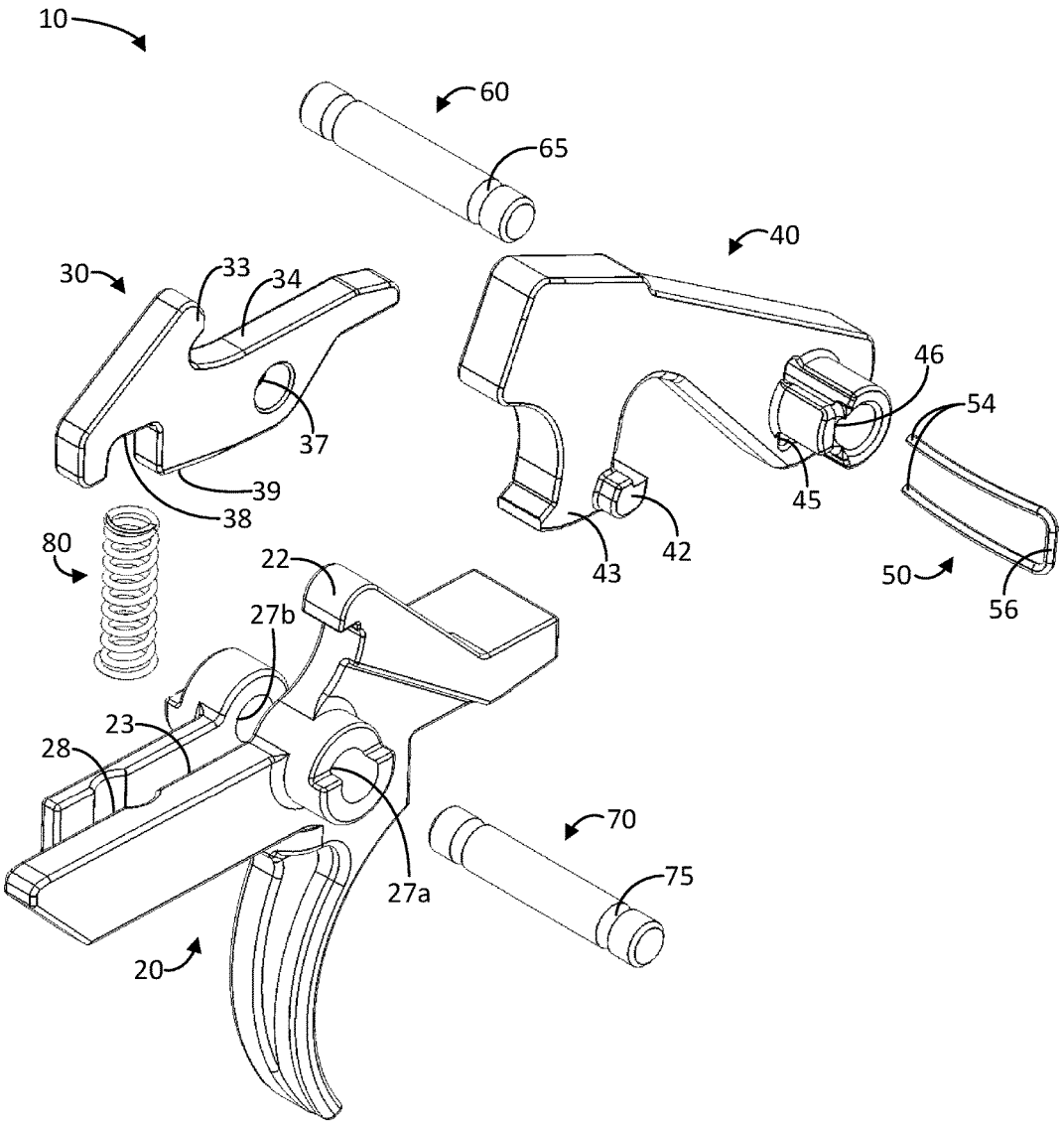
Figure 3A:
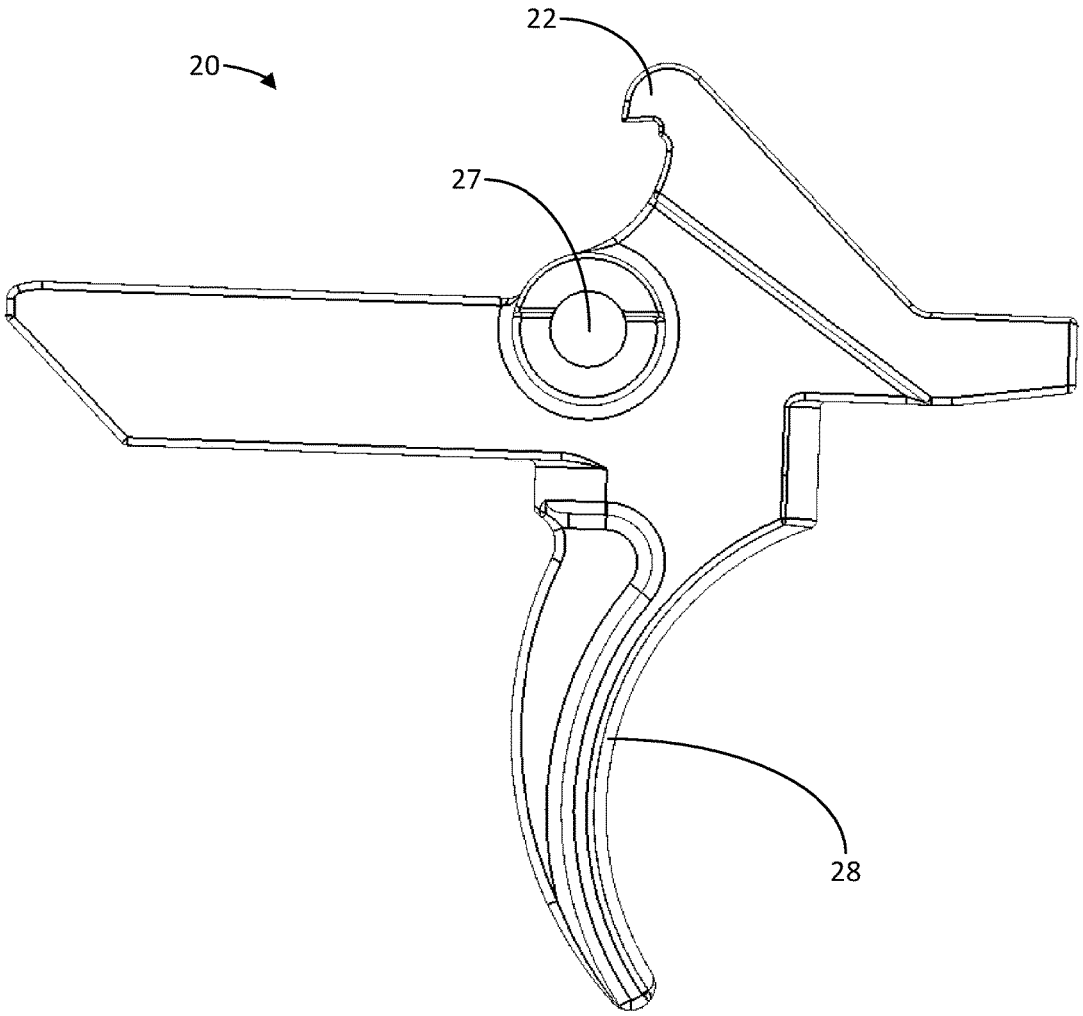
FIG. 3A-C illustrate right planar views of a trigger, disconnect, and hammer, respectively, of the trigger assembly of FIG. 1.
Figure 3B:
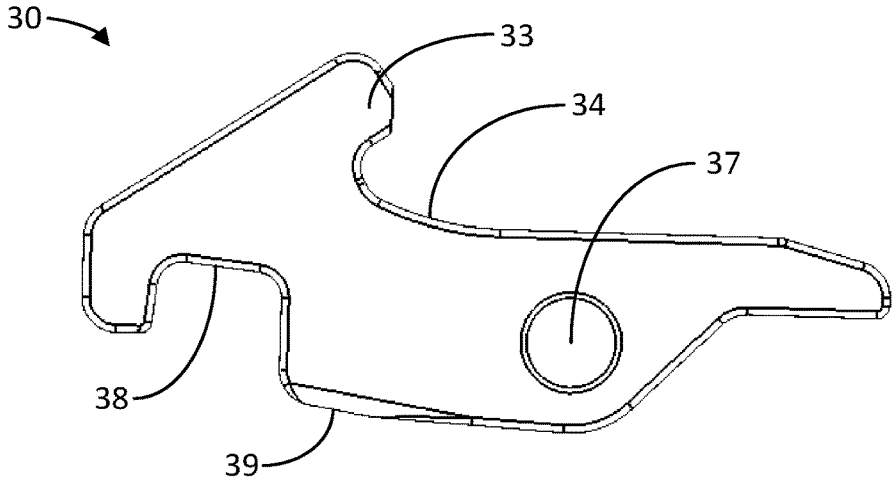
Figure 3C:
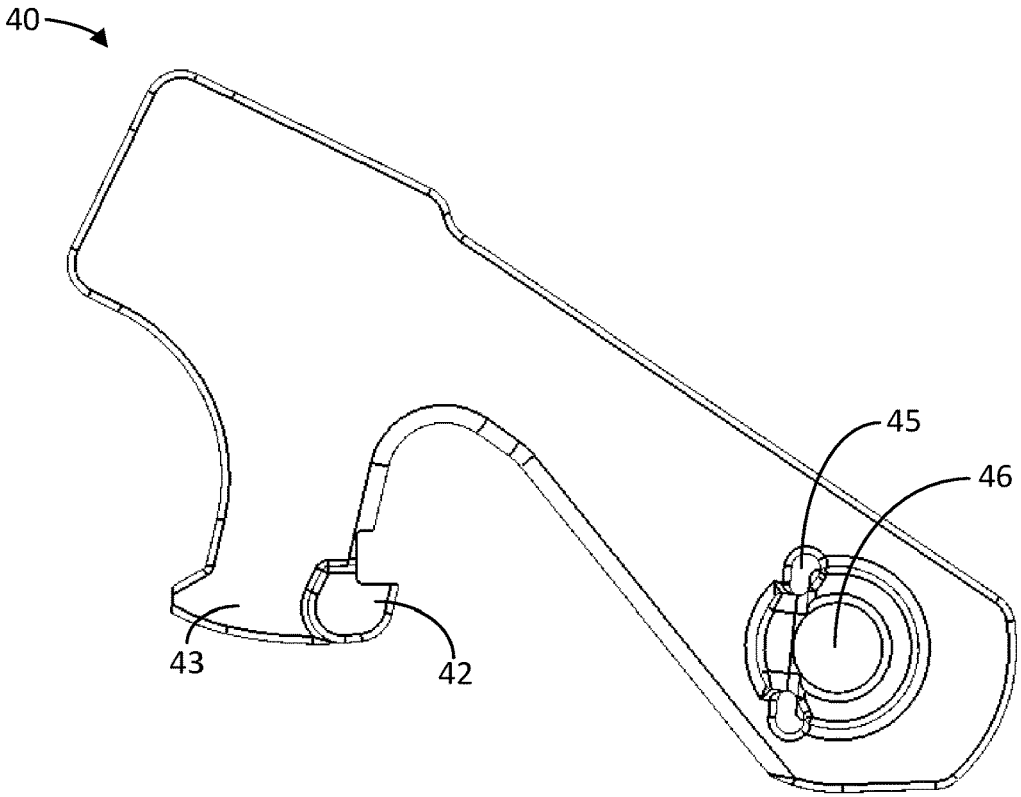

FIGS. 1 and 2 illustrate a right planar view and an exploded view, respectively, of trigger assembly 10, in accordance with an embodiment of the present invention. Generally, trigger assembly 10 includes three components: trigger 20, disconnect 30, and hammer 40. Right planar views of the trigger 20, disconnect 30, and hammer 40 are shown in FIGS. 3A, 3B, and 3C, respectively. Each of the three components 20, 30, 40 may be configured to be pivotally coupled to a firearm receiver or frame (not shown) when installed in a firearm. For example, trigger assembly 10 may be installed in various pistols (e.g., the P220® pistol), various rifles (e.g., the SIG516® rifle), and various machine/submachine guns (e.g., the SIG MPX™ submachine gun), just to name a few firearm examples (note that the specific firearm examples provided are all produced by Sig Sauer, Inc.). In some embodiments, trigger assembly 10 may be used for semi-automatic or (fully) automatic firearms. Trigger assembly 10 as described herein may also be used on replica firearms, such as airsoft guns, for example. However, trigger assembly 10 as variously disclosed herein is not intended to be limited for use with any particular firearm, unless otherwise indicated.

FIG. 1 illustrates trigger assembly 10 in an assembled, uninstalled state (e.g., assembled trigger assembly 10 is not installed in a firearm receiver or frame). As will be apparent in light of this disclosure, trigger assembly 10 can be installed in a firearm receiver (e.g., the lower receiver of some rifles). In some embodiments, installation may include aligning trigger 20, disconnect 30, and hammer 40 in a firearm receiver and then inserting hammer pivot pin 60 and trigger pivot pin 70 through one or more corresponding holes in the receiver such that trigger 20 and disconnect 30 (using trigger pivot pin 70), and hammer 40 (using hammer pivot pin 60) are all pivotally coupled to the receiver. Further, trigger 20, disconnect 30, and hammer 40 may all be spring-loaded when installed in the firearm receiver. For example, disconnect spring 80 may be used to spring-load disconnect 30 relative to trigger 20, as will be discussed in more detail below. In addition, trigger spring 82 may be used to spring-load trigger 20 and hammer spring 84 may be used to spring-load hammer 40, when trigger assembly 10 is installed in a firearm receiver. Trigger spring 82 and hammer spring 84 are shown in FIG. 1 for illustrative purposes (however, the springs 82, 84 are not shown in subsequent figures for ease of description).

FIG. 2 helps illustrate a method of assembling trigger assembly 10 of this particular embodiment. For example, trigger 20 and disconnect 30 can be pivotally coupled using trigger pivot pin 70 (or some other pin or suitable coupling componentry). In some embodiments, trigger pivot pin 70 may be selected from pivot pins from pre-existing trigger assemblies. For example, in one embodiment, trigger pivot pin 70 may be selected from an M16 rifle trigger pivot pin. Trigger 20 includes, in this embodiment, integral trigger sear hook 22 and disconnect slot 23 (e.g., as can be seen in FIGS. 2 and 3A), which will be discussed in more detail herein. As shown in FIG. 2, disconnect slot 23 is alongside or adjacent to trigger sear hook 22, such that there is no overlap between disconnect slot 23 and trigger sear hook 22. In this embodiment, trigger 20 also includes trigger pin holes 27*a*, 27*b* and disconnect spring receiver slot 28, as will be discussed in more detail below. Trigger 20, in this embodiment, also includes trigger lever 29 (e.g., as indicated in FIG. 1), which is configured to be accessible when trigger 20 is installed in a firearm receiver, such that a shooter can pull trigger lever 29 toward the rear of the firearm (e.g., using one or more fingers). Disconnect 30 includes, in this embodiment, integral disconnect sear feature 33, integral disconnect cam 34, disconnect pin hole 37, disconnect spring surface 38, and stop surface 39 (e.g., as can be seen in FIGS. 2 and 3B), each of which will be discussed in more detail below.

Continuing with the exploded view of the example embodiment shown in FIG. 2, disconnect slot 23 in trigger 20 is configured to receive disconnect 30, when trigger 20 and disconnect 30 are assembled (e.g., when trigger 20 and disconnect 30 are pivotally coupled). After inserting disconnect 30 into trigger disconnect slot 23 such that disconnect pin hole 37 aligns with trigger pin holes 27*a* and 27*b*, trigger pivot pin 70 can be inserted through right/left trigger pin hole 27*a/b*, then through disconnect pin hole 37, and then through left/right trigger pin hole 27*b/a*, for example. Prior to pivotally coupling trigger 20 and disconnect 30 with trigger pivot pin 70, disconnect spring 80 can be placed in disconnect spring receiver slot 28 in trigger 20. Therefore, when trigger 20 and disconnect 30 are pivotally coupled (e.g., as shown in FIG. 1), the bottom of disconnect spring 80 contacts trigger 20 and the top of disconnect spring 80 contacts disconnect 30 at disconnect spring surface 38, which may place spring 80 in compression. Further note that, when pivotally coupled (or otherwise assembled), disconnect 30 can be at least partially located in disconnect slot 23 and disconnect 30 can be located alongside or adjacent to trigger sear hook 22. In other words, when disconnect 30 is pivotally coupled to trigger 20, viewing the assembly from above (or from a top planar view) there is no overlap between disconnect 30 and trigger sear hook 22. The resulting assembly of trigger 20, disconnect 30, trigger pivot pin 70, and disconnect spring 80 can be seen in FIG. 4A.

When installing trigger 20 and disconnect 30 (and disconnect spring 80) in a firearm receiver, the components can be placed in the appropriate location within the receiver, and then trigger pivot pin 70 can be inserted through the appropriate receiver hole prior to inserting pin 70 through trigger 20 and disconnect 30 (e.g., as previously described). Trigger pivot pin 70 may be secured in trigger assembly 10 by ends 85 of hammer spring 84 (e.g., as shown in FIG. 1), when trigger assembly 10 is installed in a firearm receiver. In this example embodiment, hammer spring ends 85 (as can be seen in FIG. 1) align with trigger pin grooves 75 (as indicated in FIG. 2), and when hammer spring 84 is in compression, hammer spring ends 85 will maintain pressure against pin grooves 75 to prevent trigger pivot pin 70 from moving along trigger pin holes 27*a*, 27*b* and thereby retain trigger pivot pin 70 in trigger assembly 10. Hammer spring ends 85 can also help with aligning trigger pivot pin 70 when inserting pin 70 in a firearm receiver to install trigger 20 and disconnect 30 in the receiver (since trigger pin grooves 75 can provide feedback when pin 70 has been fully inserted and hammer spring ends 85 enter grooves 75).

The pull weight(s) of trigger 20 in assembly 10 can be selected, in some embodiments, based on the characteristics of disconnect spring 80, trigger spring 82, and hammer spring 84 (shown in FIG. 1). For example, the spring constant or pre-compression (when installed in a firearm receiver) of the springs 80, 82, and 84 may be chosen to achieve one or more desirable pull weight(s) for trigger 20. In some embodiments, the pull weight of trigger 20 may be based on other aspects of trigger assembly 10 (e.g., the friction at the pivot point of trigger 20) and the pull weight may be adjusted in another suitable manner, as will be apparent in light of this disclosure. In some embodiments, trigger 20 may be configured to have an overall pull weight between 0.91 kg (2 lbs) and 2.49 kg (5.5 pounds) when installed in a firearm receiver (e.g., when trigger 20 is pivotally coupled to the receiver). Pull weights in that range may be selected when trigger assembly 10 is to be used as a match trigger. In other embodiments, the pull weight(s) may be outside of that range. For example, trigger assembly 10 may be configured to have a pull weight that is greater than 2.49 kg (5.5 pounds) for safety reasons or other suitable reasons. Any suitable pull weight for trigger 20 may be selected based on the configuration of trigger assembly 10 and the present disclosure is not intended to be limited to any specific pull weight(s) unless otherwise indicated.

Continuing with the exploded view of the example embodiment shown in FIG. 2, hammer 40 can be pivotally coupled to a firearm receiver using hammer pivot pin 60 (or some other pin or suitable coupling componentry). In some embodiments, hammer pivot pin 60 may be selected from pre-existing trigger assemblies. For example, in one embodiment, hammer pivot pin 60 may be selected from an M16 rifle trigger pivot pin. Hammer 40 includes, in this embodiment, integral hammer cam 43 and hammer sear hook 42 (e.g., as can be seen in FIGS. 2 and 3C), which will be discussed in more detail herein. Hammer 40 also includes hammer pin hole 46 and hammer pin retainer apertures 45. Note that hammer pin retainer apertures 45 may be indents, slots, depressions, or any suitable hole in hammer 40, and, in some instances, may include only one aperture or more than two apertures. Also note that, in this embodiment, the axis of apertures 45 are substantially parallel to the axis of hammer pin hole 46, which can provide benefits from a manufacturing standpoint (e.g., not having to rotate the part when creating hole 46 and apertures 45) and from a structural integrity standpoint. As previously described, hammer 40 can be pivotally coupled to a firearm receiver using hammer pivot pin 60. For example, hammer 40 can be aligned in the proper position within a firearm receiver and then hammer pivot pin 60 can be inserted through a corresponding hole in the receiver and then through hammer pin hole 46 (and then possibly through a hole in the opposite side of the receiver).

Figure 5:
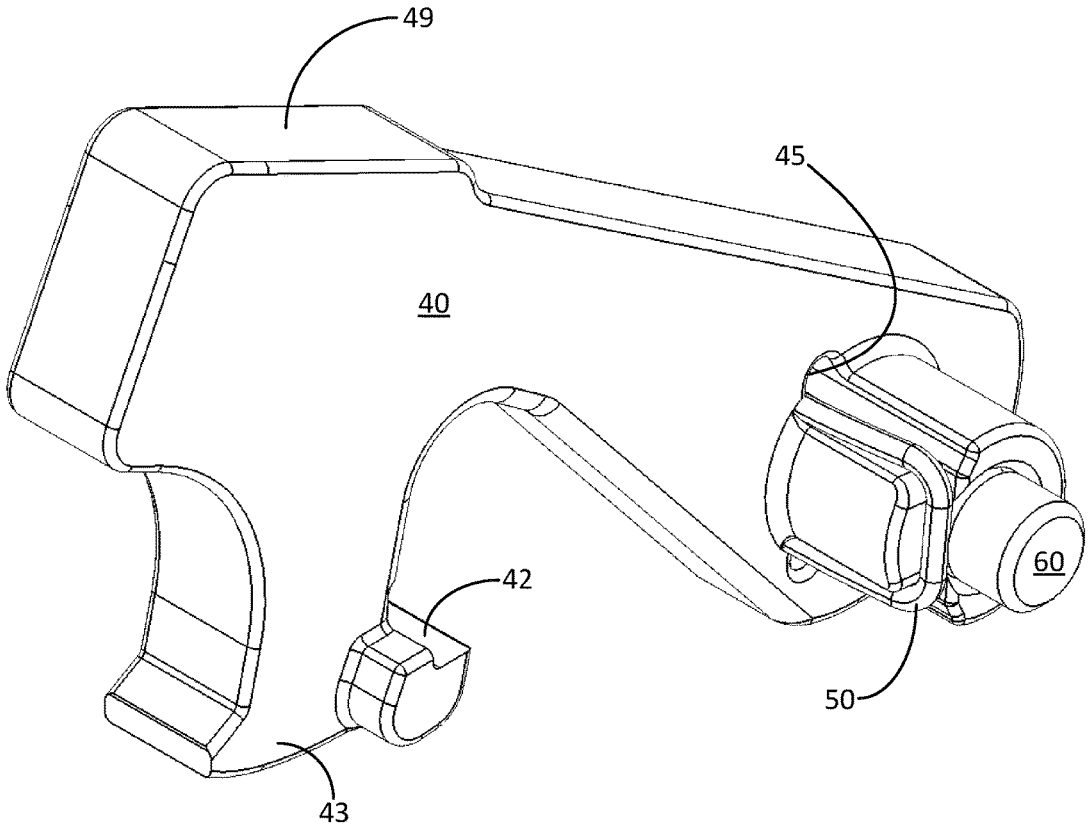
FIG. 5 illustrates an isometric view of an assembly of a hammer, hammer pivot pin, and hammer pin retainer of the trigger assembly of FIG. 1.

In some embodiments, hammer pivot pin 60 may be non-permanently retained in hammer 40 using hammer pin retainer 50 (or some other suitable pin retainer). For example, as shown in FIGS. 2 and 3C, hammer 40, in this example embodiment, includes hammer pin retainer apertures 45, which are configured to receive ends 54 of hammer pin retainer 50. Hammer pin retainer 50, in this embodiment, can be inserted into apertures 45 in a direction substantially parallel to a major axis of hammer pivot pin 60 (i.e., the axis of rotation of the pin). Therefore, in this embodiment, hammer pin retainer 50 is substantially parallel to hammer pivot pin 60, as can be seen in FIG. 5. Further, hammer pin retainer 50, in this embodiment, is loosely retained by friction when hammer 40 and retainer 50 are together outside of a firearm receiver. Once hammer 40 and retainer 50 are installed in a receiver, retainer 50 becomes trapped in hammer 40 by the interior wall of the receiver. In another embodiment, hammer pin retainer 50 may be bent such that it can be friction fit when inserted into hammer pin retainer apertures 45.

FIG. 5 shows the resulting assembly of hammer 40, hammer pivot pin 60, and hammer pin retainer 50, in accordance with an embodiment of the present invention. As can be seen, connecting portion 56 of hammer pin retainer 50 (e.g., as indicated in FIG. 2) sits in hammer pin groove 65 (e.g., as also indicated in FIG. 2) to help retain hammer pivot pin 60 in hammer pin hole 46. Hammer pin retainer 50 can also help with aligning hammer pivot pin 60 when inserting pin 60 in a firearm receiver to install hammer 40 in the receiver (since hammer trigger pin groove 65 can provide feedback when pin 60 has been fully inserted and connecting portion 56 enters groove 65). Note that surface 49 of hammer 40 can be used to strike a firing pin, for example, to cause a firearm to fire, as will be apparent in light of this disclosure.

In the embodiment shown in FIG. 5, hammer pin retainer 50 is configured such that connecting portion 56 sits in a hammer pin groove that is off-center and near the end of the pivot pin (e.g., as is the case with hammer pivot pin 60 and its off-center integral grooves 65). This configuration provides the advantage of using a hammer pivot pin that lacks a problematic central groove (e.g., a groove in the middle of its length or located to align with the center of the hammer). A hammer pivot pin may be configured with a problematic central groove where the hammer pin retainer is normal to the axis of rotation of the pivot pin and aligned with a major axis of the hammer, for example. A hammer pivot pin with a central groove is problematic because it can provide a mechanical breaking point for failure of such hammer pivot pins due to, for example, the reduced diameter of the pin at its most critical location (e.g., the most stressed location during the firing sequence). Further, the hole for receiving the pin retainer (when using such problematic hammer pivot pins) may be required to be formed longitudinally through the hammer (as opposed to the transverse pin retainer holes 45 in hammer 40 shown in FIG. 2), weakening the structural integrity of the hammer. Therefore, using hammer pin retainer 50, as variously described herein, provides the benefit of being able to use a hammer pivot pin with off-center grooves (such as hammer pivot pin 60), which prevents the need for a hammer pivot pin that has a problematic central groove.

The particular order of assembly and/or installation for trigger assembly 10 as described herein is provided as one example; however, trigger assembly 10 may be assembled in another suitable manner. Further the shapes and sizes of the components of trigger assembly 10 may vary between embodiments. For example, the size and shape of trigger 20, disconnect 30, and hammer 40 may be selected based on the particular firearm and/or firearm receiver it is intended to be installed in. The components of trigger assembly 10, including trigger 20, disconnect 30, hammer 40, trigger pivot pin 70, hammer pivot pin 60, hammer pin retainer 50, disconnect spring 80, trigger spring 82, hammer spring 84, and any other components as will be apparent in light of this disclosure, can be constructed from any suitable material, such as various metals (e.g., aluminum, steel, or any other suitable metal or metal alloy material) or plastics (e.g., polymers, such as polystyrene, polycarbonate, polypropylene, and acrylonitrile butadiene styrene (ABS), or any other suitable polymer or plastic material). In an example embodiment, trigger 20 and hammer 40 are constructed from case-hardened steel (e.g., 8620), and disconnect 30 is constructed from through hardened high-carbon steel. In an example embodiment, trigger 20, disconnect 30, and hammer 40 are all constructed from low alloy steel.

Figure 6A:
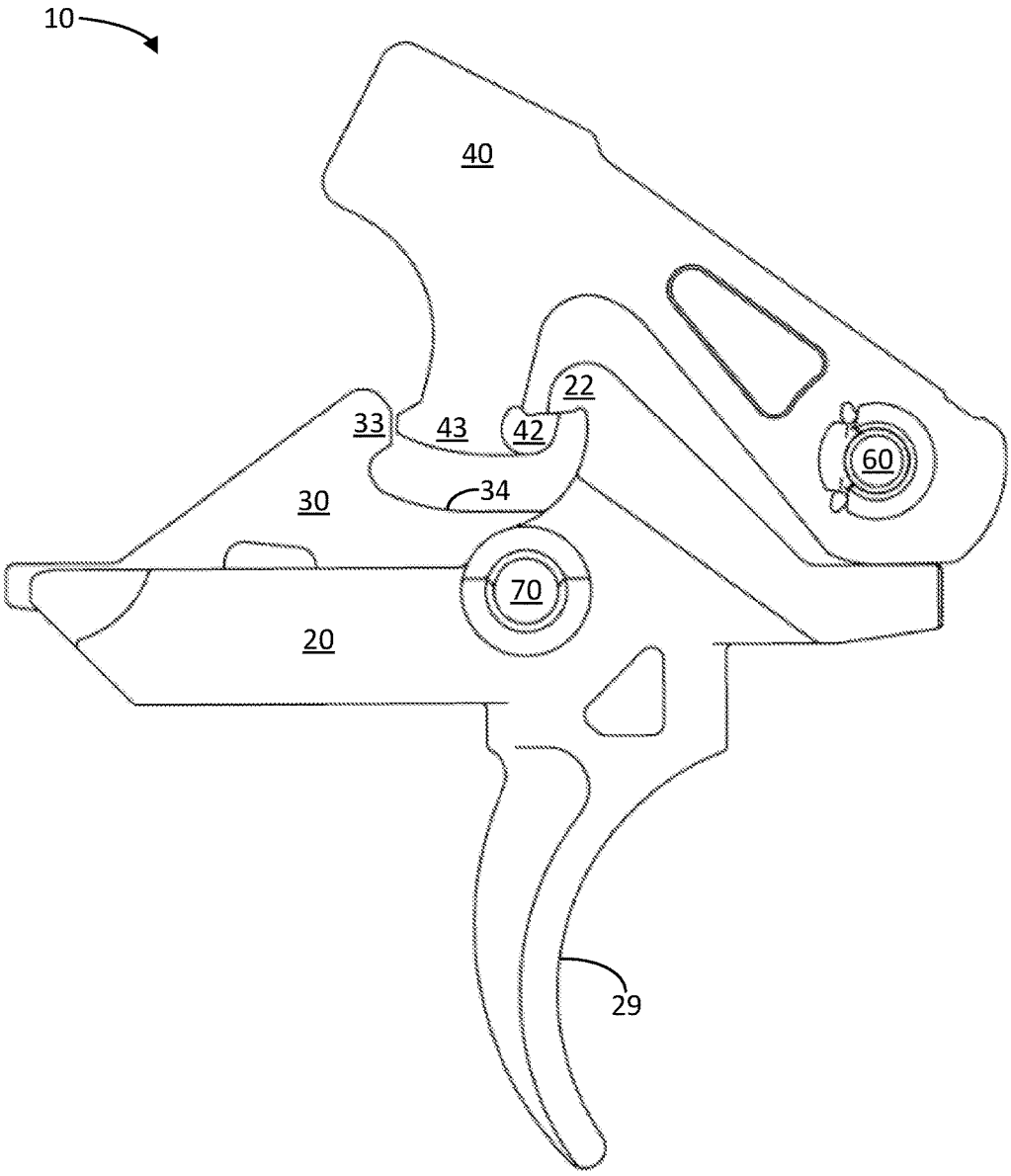
FIGS. 6A-F illustrate a right planar view of multiple firing sequence positions of a trigger assembly configured in accordance with an embodiment of the present invention.

FIGS. 6A-F illustrate a right planar view of multiple firing sequence positions of trigger assembly 10, in accordance with an embodiment of the present invention. FIG. 6A shows trigger assembly 10 with hammer 40 in a cocked position and trigger 20 in a default (non-fire) position, in accordance with an embodiment. In this embodiment, when trigger assembly 10 is installed in a firearm receiver, trigger lever 29 can be pulled toward the rear of the firearm (e.g., by a shooter's finger) to actuate the firing sequence of a firearm. Trigger assembly 10 in this embodiment is a two-stage trigger, where the firing sequence is actuated after two distinct pull stages, as will be described in more detail below. Recall that when installed in a firearm receiver, disconnect spring 80, trigger spring 82, and hammer spring 84 (shown in FIG. 1) apply torque on disconnect 30, trigger 20, and hammer 40, respectively. From the perspective of the right planar view shown in FIG. 6A, when installed in a firearm receiver with springs 80, 82, and 84, the torque applied on disconnect 30 is a clockwise torque, the torque applied on trigger 20 is a counter-clockwise torque, and the torque applied on hammer 40 is a clockwise torque. The multiple firing sequence positions illustrated in FIG. 6A-F will be discussed herein as though such torques are being applied by springs 80, 82, and 84 on disconnect 30, trigger 20, and hammer 40, respectively.

Figure 4A:
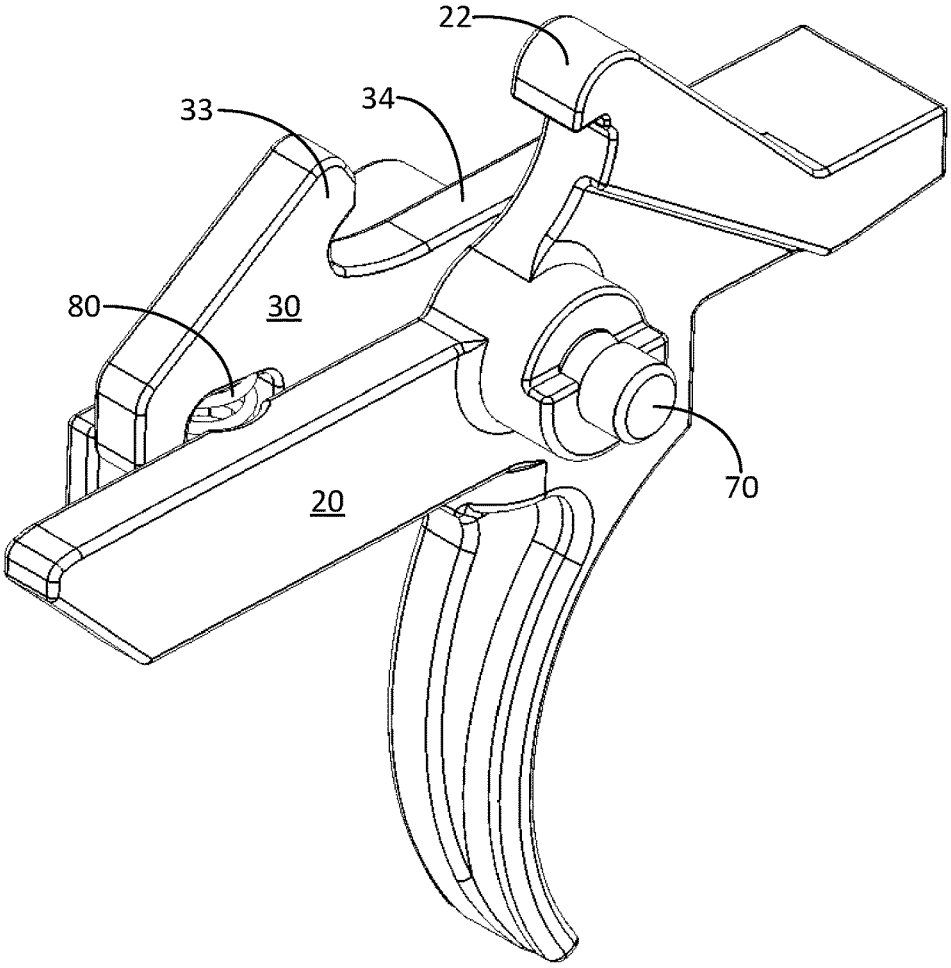
FIG. 4A illustrates an isometric view of an assembly of a trigger, disconnect, trigger pivot pin, and disconnect spring of the trigger assembly of FIG. 1.
Figure 4B:
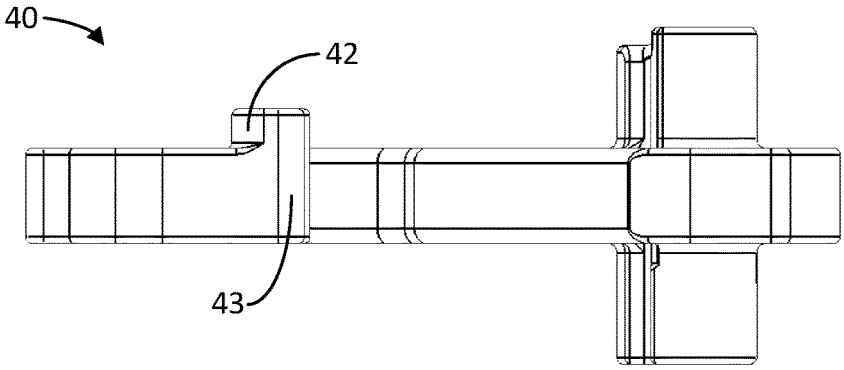
FIG. 4B illustrates a bottom planar view of a hammer of the trigger assembly of FIG. 1.

In the cocked position shown in FIG. 6A, trigger sear hook 22 provides a mechanical stop for hammer sear hook 42, as can be seen, thereby preventing hammer 40 from rotating in a forward/firing direction. In this embodiments, trigger sear hook 22 (e.g., as shown in FIGS. 3A and 4A) and hammer sear hook 42 (e.g., as shown in FIGS. 3C and 4B) have hooked shapes that allow trigger sear hook 22 to catch hammer sear hook 42 and provide a mechanical stop, as shown in FIG. 6A. In other embodiments, the integral sear features/surfaces of trigger 20 and hammer 40 may have different shapes or sizes, but still be configured to provide a mechanical stop to hammer 40 and hold hammer 40 back until the correct amount of pressure has been applied to trigger lever 29 to release hammer 40. Recall that trigger sear hook 22 is integral with trigger 20 and hammer sear hook 42 is integral with hammer 40, thereby preventing the need for extra components (e.g., preventing the need for a separate trigger sear hook).

Figure 6B:
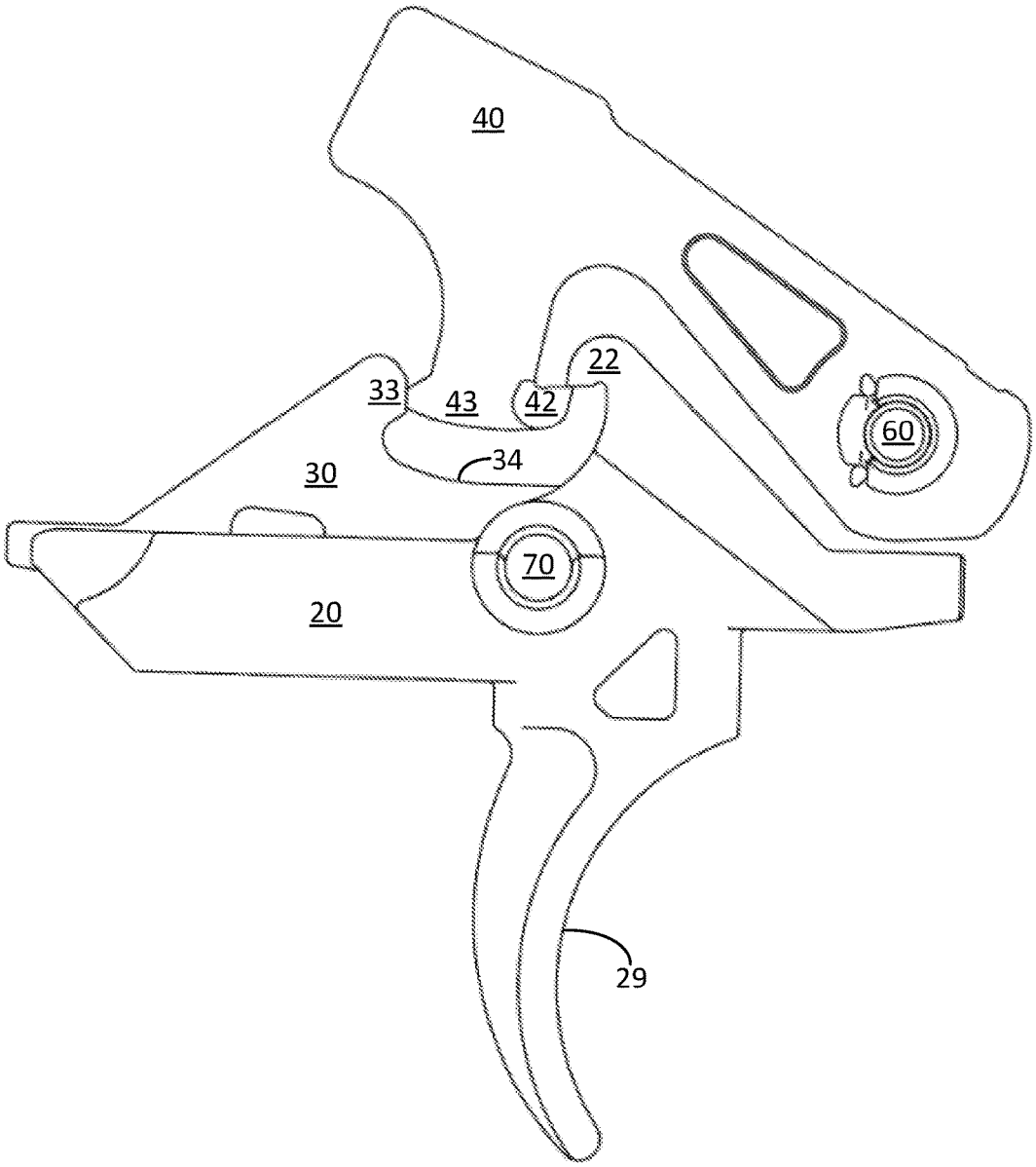

FIG. 6A shows trigger 20 resisting the rotational bias of hammer 40 (e.g., as described above). Initial rotation of trigger 20 from the position shown is resisted by the load of trigger spring 82, and by drag created at the trigger/hammer contact surface (e.g., between trigger sear 22 and hammer sear 42) from the load generated by hammer spring 84. This represents the first stage of the two-stage trigger pull of this embodiment. As trigger 20 is pulled (e.g., using trigger lever 29), disconnect 30 rotates with trigger 20, and continues to do so until contacting hammer 40, as shown in FIG. 6B. This ends the first trigger pull stage for trigger assembly 10.

FIG. 6B shows hammer 40 (and more specifically, integral hammer cam 43) in contact with disconnect sear feature 33. This begins the second stage of the two-stage trigger pull of this embodiment. Further rotation of trigger 20 (e.g., using trigger lever 29) requires that disconnect spring 80 be compressed and results in a second trigger pull weight that is greater than the first stage pull weight, and which thereby notifies the operator of the imminent release of hammer 40. In some embodiments, the two-stage trigger pull effect may be accomplished in another suitable manner. In other embodiments, the trigger assembly may be configured to be a single stage trigger, providing only one pull weight and requiring only one trigger pull to initiate the firing sequence. In the embodiment shown in FIG. 6B, further rotation of trigger 20 (e.g., by pulling trigger lever 29) results in the release of hammer 40 as shown in FIG. 6C.

Figure 6C:
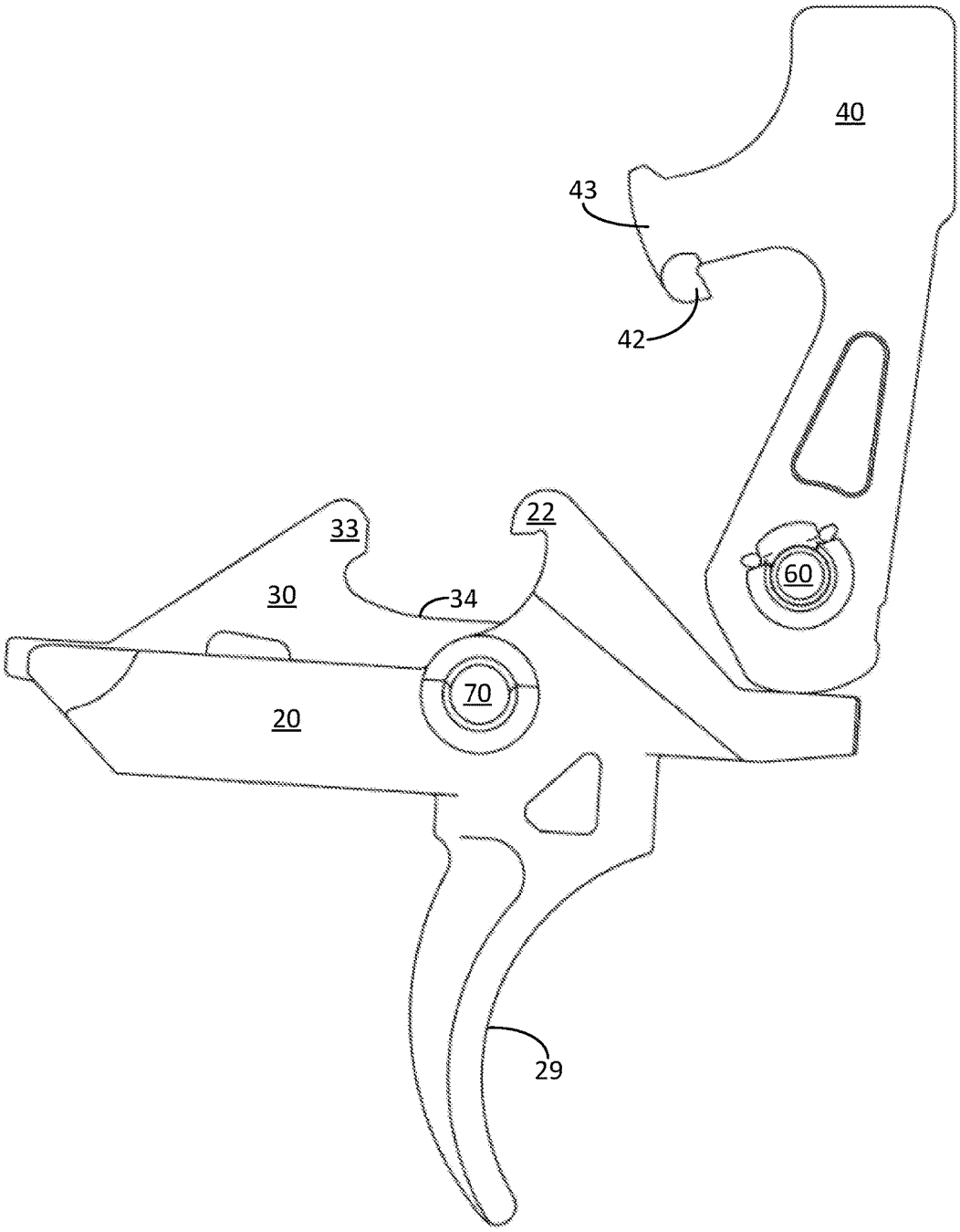

FIG. 6C shows trigger assembly 10 with hammer 40 uncocked as a result of trigger lever 29 having been pulled (e.g., by a shooter's finger) to release hammer 40, in accordance with an embodiment. In this example embodiment, pulling trigger lever 29 past both the first and second trigger stages caused trigger 20 (and also disconnect 30) to rotate in a clockwise direction (relative to trigger pivot pin 70) to the position shown. As a result, hammer 40 rotates in a clockwise direction (relative to hammer pivot pin 60) to the position shown in FIG. 6C. As previously described, the pull weights required to release hammer 40 may be selected based on, for example, the specific disconnect spring 80, trigger spring 82, and hammer spring 84 used. In the position shown, hammer 40 may make contact with, for example, a firing pin to cause a cartridge to discharge. Note that hammer 40 may make contact with a firing pin (or other suitable firing component) at another suitable position after being released, based on the particular firearm being used, and that the position of hammer 40 shown in FIG. 6C is for illustrative purposes only.

Figure 6D:
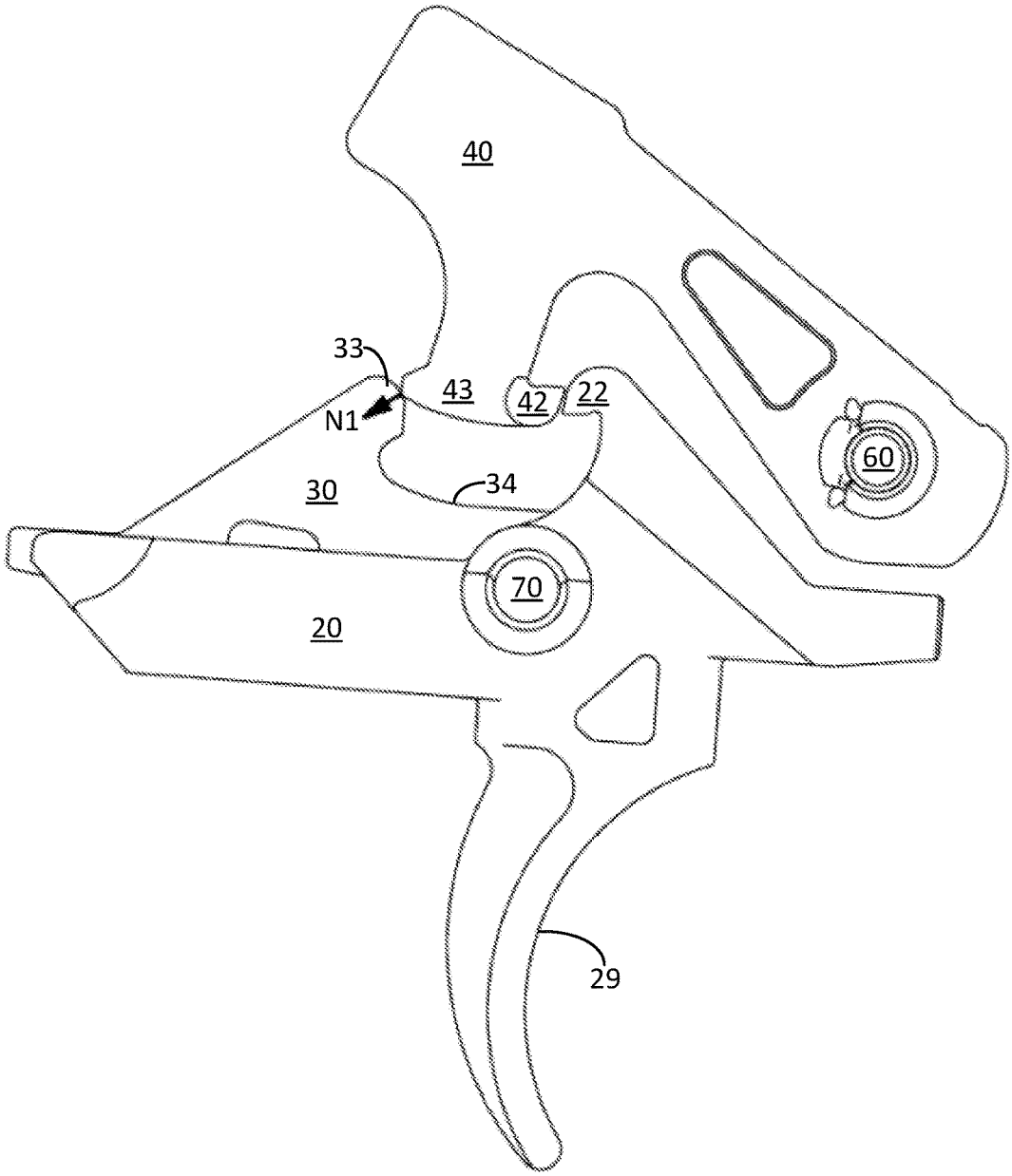

FIG. 6D shows trigger assembly 10 after hammer 40 is rotated back by the recoil stroke of the carrier and bolt (not shown) of the firearm, in this example embodiment. As can be seen, hammer 40 first contacts disconnect 30 at disconnect sear feature 33. The normal contact vector is shown as N1. This contact causes disconnect 30 to rotate and allow the rear of hammer cam 43 to pass by sear feature 33. Note that hammer 40 is driven through the 33/43 contact shown in FIG. 6D, but departs contact with the carrier prior to the 34/43 contact shown in FIG. 6E. This allows disconnect cam 34 to completely decelerate hammer 40 without also having to completely decelerate the carrier and bolt. Although feature 34 is referred to as an integral disconnect cam herein, it may also be considered the main body portion of disconnect 30, a follower for integral hammer cam 43, or some other suitable feature in light of this disclosure. Note that the specific integral hammer cam 43 and integral disconnect cam 34 (e.g., as shown in FIG. 6E) are provided for illustrative purposes and are not intended to limit the present disclosure to any particular shape/size for either cam feature 43 or 34, unless otherwise indicated.

Figure 6E:
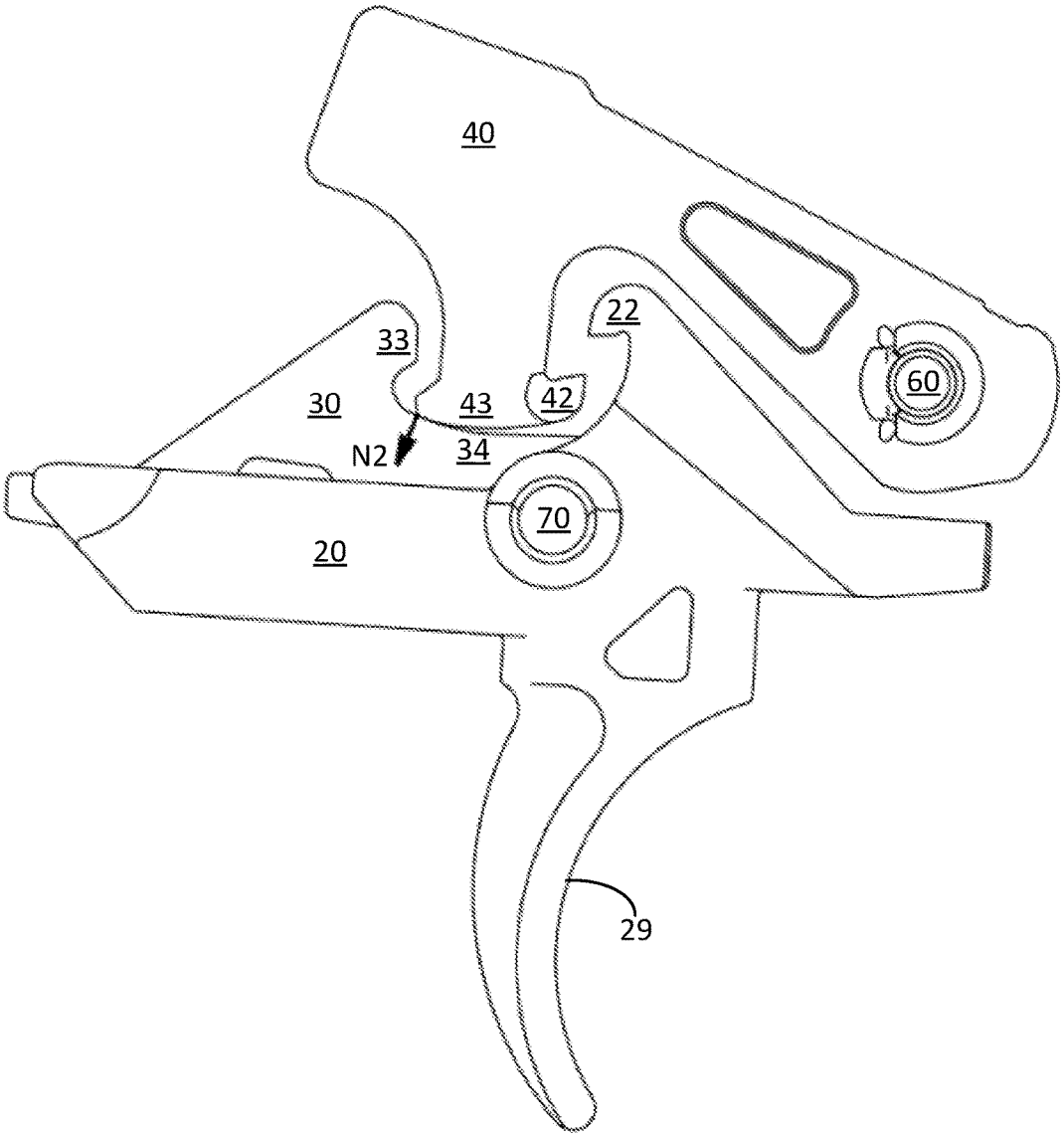
Figure 6F:
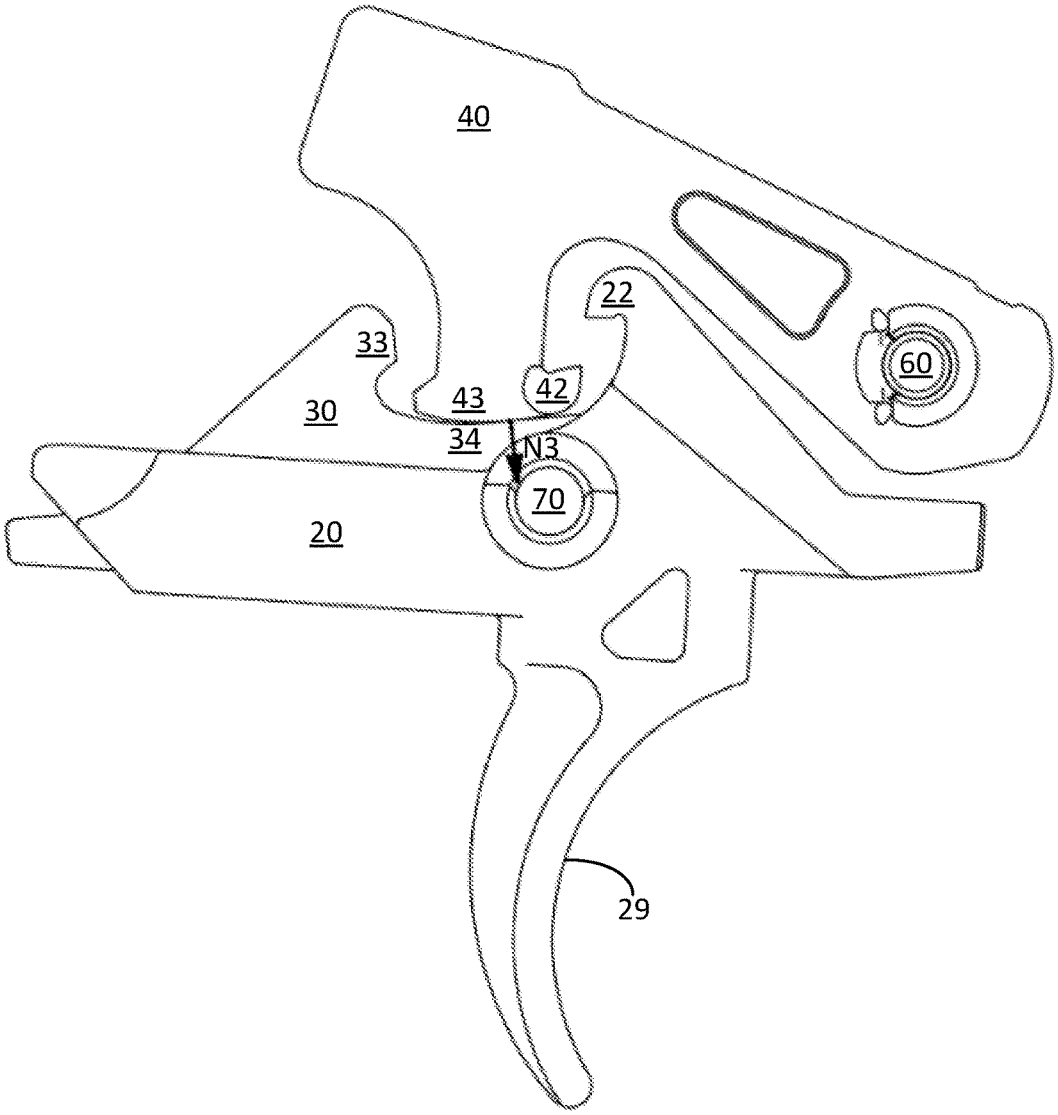

FIG. 6E shows trigger assembly 10 as hammer 40 continues to rotate during firearm recoil as a result of its own inertia. The normal contact vector N2 shown in FIG. 6E is at first distant from trigger pivot pin 70, and therefore, hammer 40 is offered little (or a lower amount of) resistance as it begins to rotate disconnect 30 and compress disconnect spring 80. As these components continue to move, however, the normal contact vector migrates toward trigger pivot pin 70 and resistance to hammer 40 travel increases as hammer 40 becomes opposed with increasing efficiency by the firearm receiver. For example, FIG. 6F shows normal contact vector N3 after continued rotation of hammer 40, and as can be seen, vector N3 has migrated toward pivot pin 70 (e.g., as compared to N2 shown in FIG. 6E). Were the normal contact vector to continue to migrate in this direction and come to pass directly through the center of trigger pivot pin 70, then resistance to hammer 40 travel would become great. However, excess energy in the rotating hammer 40 during firearm recoil is exhausted before such an alignment can be achieved. Note that, in this embodiment, the contact between hammer 40 and disconnect 30 (when integral hammer cam 43 contacts integral disconnect cam 34) is favorably approximate to the center of percussion of hammer 40.

To the degree in which disconnect spring 80 is compressed against trigger 20, and to which disconnect 30 may be allowed to rotate into contact with trigger 20, some small portion of the remaining energy from hammer 40 during firearm recoil will still be directed via trigger 20 into the finger of the shooter. However, such energy directed into the finger of the shooter is buffered by the interaction between integral hammer cam 43 and integral disconnect cam 34. Therefore, as the buffering (provided by cams 43 and 34) is performed over a significant period of time and travel (as is the case in this example embodiment), the high shock loads and damaged parts associated with the collision between the hammer and disconnect can be avoided. Since firearm recoil motion has ended in the position shown in FIG. 6F, hammer 40 may return to the cocked position shown in FIG. 6A (e.g., when the shooter releases trigger lever 29 to stop firing) or repeat the firing sequence to discharge another ammunition round (e.g., for automatic firearms). For example, as hammer 40 first rises from the position shown in FIG. 6F, hammer 40 contacts the bottom of the carrier, and disconnect 30 rotates to cover the secondary sear surface of hammer 40. As the carrier continues to move towards battery, it uncovers hammer 40 and hammer 40 then comes to rest against disconnect sear feature 33. As shooter releases trigger 20 (e.g., by releasing trigger lever 29) to stop firing, trigger 20 and disconnect 30 rotate together to release hammer 40 at disconnect sear feature 33. Hammer 40 can then rise to come to rest as shown in FIG. 6A.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The term "integral" as used herein in the specification and in the claims with reference to various features of the trigger assembly (e.g., the trigger sear feature, hammer sear feature, disconnect cam, hammer cam, etc.), should be understood to mean of, or pertaining to, a single molded/formed part (e.g., the trigger, hammer, disconnect, etc.), such that removing an integral feature would result in a material deformation of that part.

The indefinite articles "a" and "an" as used herein in the specification and in the claims, unless clearly indicated to the contrary, should be understood to mean "at least one."

The phrase "and/or" as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A hammer for a firearm trigger mechanism, the hammer comprising:

a body having a first end and a second end;

an integral cam feature on the first end of the body;

an integral sear feature adjacent to the integral cam feature;

the second end of the body defining a pivot pin hole, the pivot pin hole having a longitudinal axis;

the second end of the body defining one or more pivot pin retainer apertures adjacent to the pivot pin hole, each pivot pin retainer aperture having a longitudinal axis, wherein each longitudinal axis of the one or more pivot pin retainer apertures is substantially parallel to the longitudinal axis of the pivot pin hole;

a pivot pin configured to insert into the pivot pin hole; and a pivot pin retainer configured to insert into the one or more pivot pin retainer apertures, wherein the pivot pin retainer is further configured to non-permanently retain the pivot pin in the pivot pin hole.

2. The hammer of claim 1, wherein the pivot pin enables the hammer to pivotally couple to a firearm receiver.

3. The hammer of claim 1, wherein the pivot pin includes a groove configured to receive at least a portion of the pivot pin retainer.

4. The hammer of claim 3, wherein the groove is off-center and near an end of the pivot pin.

5. The hammer of claim 3, wherein the groove circles a longitudinal axis of the pivot pin.

6. The hammer of claim 1, wherein the pivot pin retainer is substantially U-shaped and includes two ends.

7. The hammer of claim 6, wherein the two ends of the substantially U-shaped pivot pin retainer are each configured to insert into distinct pivot pin retainer apertures.

8. The hammer of claim 1, further comprising a surface adjacent the first end of the body and configured to strike a firing pin of a firearm.

9. The hammer of claim 1, wherein the integral sear feature is hook-shaped and configured to interact with a firearm trigger sear feature.

10. The hammer of claim 1, wherein the integral cam feature is curved and configured to interact with a firearm trigger disconnect cam feature.

11. A firearm comprising the hammer of claim 1.

* * * * *